United States Patent [19]

Lew

[11] 4,391,572

[45] Jul. 5, 1983

[54] ANGULAR POSITION BELT VALVE PUMP

[76] Inventor: Hyok S. Lew, 7890 Oak St., Arvada, Colo. 80005

[21] Appl. No.: 206,302

[22] Filed: Nov. 12, 1980

[51] Int. Cl.[3] ..... F01C 5/00; F01C 21/12; F04B 43/12; F16K 3/26

[52] U.S. Cl. ..... 418/45; 418/153; 417/479; 137/625.16

[58] Field of Search ..... 418/45, 153, 156; 417/478–480, 510; 137/625.11, 625.16, 625.47; 251/DIG. 2

[56] References Cited

U.S. PATENT DOCUMENTS

| | | | |
|---|---|---|---|
| 601,634 | 4/1898 | Cotter et al. | 251/DIG. 2 |
| 1,315,812 | 9/1919 | Bozarth | 137/625.16 |
| 3,119,413 | 1/1964 | Waldo | 137/624.15 |
| 3,410,219 | 11/1968 | Shope | 418/153 |

FOREIGN PATENT DOCUMENTS

| | | | |
|---|---|---|---|
| 459707 | 5/1928 | Fed. Rep. of Germany | 418/153 |
| 2458541 | 6/1976 | Fed. Rep. of Germany | 418/153 |

*Primary Examiner*—John J. Vrablik

[57] ABSTRACT

A pump functioning as a vacuum pump or a pressure pump employing the angular position belt valve is disclosed. Said angular position belt valve comprises a plurality of axial holes disposed within a cylindrical pulley, each of which axial holes has one or more openings to the cylindrical surface of said pulley, which is wrapped by a belt over a predetermined wrap angle. When said pulley is rotated, said holes remain closed by the belt as long as those holes are within the wrap angle. When said holes are rotated out of the wrap angle, those holes become open instantly until they are rotated back into the wrap angle. Said angular position belt valve becomes an important part of a pump when each of said axial holes is connected to each of a plurality of expandingcontracting chambers disposed around the same axis of the rotation as that of the angular position belt valve wherein the wrap angle is set in such a way that a first angular position valve allows the pumped medium to enter the expanding chambers while a second angular position valve allows the pumped medium to leave the contracting chambers.

3 Claims, 7 Drawing Figures

ANGULAR POSITION BELT VALVE PUMP

It has been sought-after technology in the pump engineering to find a way to construct a pump that does not employ any seals experiencing a rubbing motion between the moving parts and the stationary parts. One answer to such a requirement was the invention of so called "liquid ring seal pump" which employs a liquid ring formed within the pump cavity by the centurifugal force in pumping. Although the liquid ring seal pump has succeded in eliminating the rubbing seals, it has introduced a new disadvantage which is the requirement of the continuous supply of the seal water that is not readily available sometimes and not desirable in other times in such cases where the pumped medium has to be dry.

The primary object of the present invention is to provide a pump operating without using any rubbing seals as well as any seal water.

Another object of the present invention is to provide a pump that operates at any speed of the revolution.

A further object of the present invention is to provide a positive displacement pump for a high volume flow.

A still another object of the present invention is to provide a mechanically simple pump that employs the minimum number of parts experiencing a relative movement.

These and other objects of the present invention will become clear as the description of the present invention proceeds. The present invention may be described with a greater clarity and specificity by referring to the figures showing an embodiment of the principles of the present invention.

Figure 1:
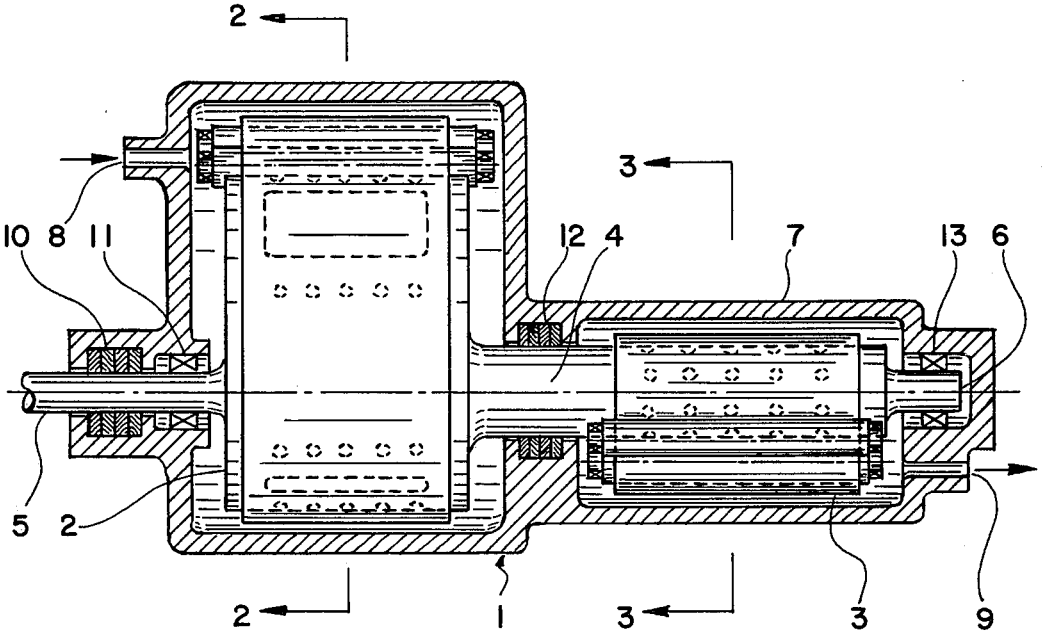
FIG. 1 illustrates an illustrative embodiment of an angular position belt valve pump viewed in a direction perpendicular to the axis of the rotation of said pump.
Figure 2:
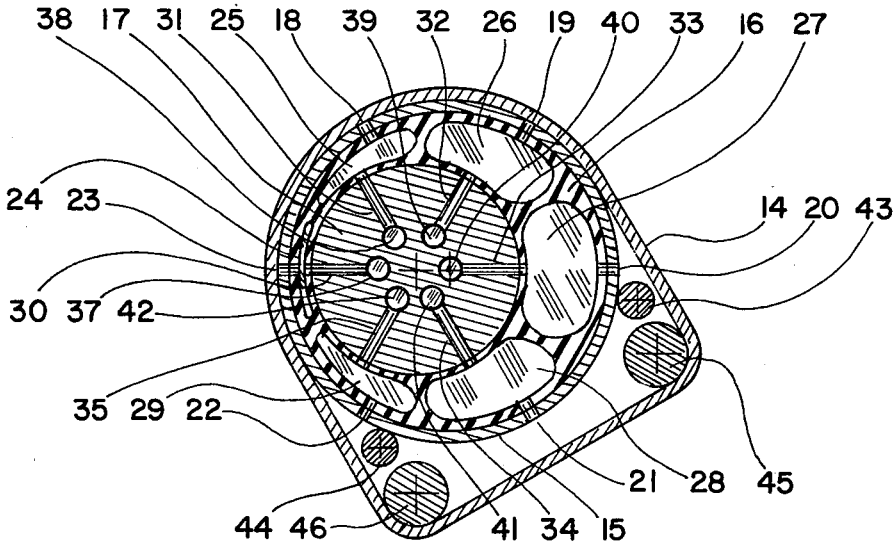
FIG. 2 illustrates a cross section of the angular position belt valve pump taken along a plane 2—2 as shown in FIG. 1.
Figure 3:
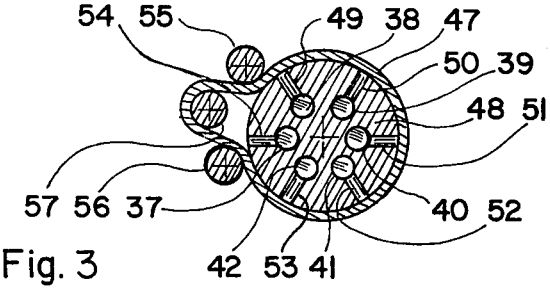
FIG. 3 illustrates another cross section of the angular position belt valve pump taken along a plane 3—3 as shown in FIG. 1.

In FIG. 1, there is shown a cross section of an angular position belt valve pump 1 taken along a plane parallel to the axis of the pump rotor, which pump is constructed in accordance with the principles taught by the present invention. The rotor of said pump comprises the shafts 5 and 6 rotatably supported by the bearings 11 and 13, respectively. The rotor is housed within the shell 7 divided into a pair of sealed compartments by means of a pair of seals 10 and 12. The pumping assembly 2 of the pump rotor is housed within the inlet side compartment of the shell including the inlet port 8, while the valve assembly 3 is housed within the outlet side compartment including the outlet 9. Said pumping assembly 2 and valve assembly 3 of the pump rotor are rigidly connected to one another by a cylindrical extension 4 through which a plurality of axial holes 37, 38, 39, 40, 41 and 42 are disposed parallel to the rotating axis of the pump rotor as shown in FIGS. 2 and 3. With said construction of the pump rotor, the pumping assembly 2 and the valve assembly 3 rotate at the same rpm about the same rotational axis.

There is shown in FIG. 2 a cross section taken along a plane 2—2 as shown in FIG. 1, wherein the detailed construction of the pumping assembly 2 of the pump rotor is shown. The belt 14 wraps around the eccentric shell 15 and travels around a pair of idlers 45 and 46. The eccentric position of the shell 15 is maintained by the tension of the belt 14 and a pair of rollers 43 and 44 while the pump rotor is being rotated. The concentric cylinder 17 is an enlarged extension of the cylindrical extension 4 connecting the pumping assembly and the valve assembly as shown in FIG. 1. The axisymmetrically disposed axial holes 37, 38, 39, 40, 41 and 42 originate in the concentric cylinder 17 and terminate in the concentric valve cylinder 48 as shown in FIG. 3. A plurality of expanding-contracting chambers 24, 25, 26, 27 28 and 29 are included within an elastic medium 16 filling the space between the concentric cylinder and the eccentric shell, which elastic medium 16 is bonded to the concentric cylinder 17 as well as to the eccentric shell 15. As a consequence, said expanding-contracting chambers are cyclically expanded and contracted when the pump rotor is rotated. Each of said expanding-contracting chambers 25, 26, 27, 28, 29 and 24 has openings 18, 19, 20, 21, 22 and 23 to the outer cylindrical surface of the eccentric shell 15, respectively, as well as openings 31, 32, 33, 34, 35 and 30 to each of the axial holes 38, 39, 40, 41, 42 and 37, respectively.

In FIG. 3, there is shown a cross section taken along a plane 3—3 as shown in FIG. 1, which illustrates the construction of the valve assembly 3 of the pump rotor, wherein the concentric valve cylinder 48 including a plurality of the axial holes 37, 38, 39, 40, 41 and 42 is wrapped by a belt 47. The belt 47 travels around the idlers 55, 56 and 57 and, consequently, the locations of said idlers relative to the concentric valve cylinder 48 determines the wrap angle. Each of the axial holes 37, 38, 39, 40, 41 and 42 has openings 54, 49, 50, 51, 52 and 53 to the cylindrical surface of the concentric valve cylinder, respectively.

With the structures and constructions of the angular position belt valve pump 1 presented in conjunction with FIGS. 1, 2 and 3, it operates in the following principle: The group of idlers 45 and 46 in the pumping assembly 2 is positioned relative to the group of idlers 55, 56 and 57 in the valve assembly in such a way that the belt 14 closes the openings from the expanding-contracting chambers to the surface of the eccentric shell 15 when said chambers are being contracted, while said openings stay open when said chambers are being expanded. At the same time, openings from those axial holes to the surface of the concentric valve cylinder 48, which axial holes connected to all of the expanding-contracting chambers other than one that is fully contracted, are closed by the belt 47, while the opening from the axial hole that is connected to the expanding-contracting chamber which is fully contracted stays open. Therefore, the openings from the axial hole to the cylindrical surface of the concentric valve cylinder 48 which is located outside of the wrap angle of belt 47 provides a passage for the pumped medium to be forced out from the fully or nearly fully contracted chamber, while those openings from the expanding-contracting chambers to the cylindrical surface of the eccentric shell 15, which are located outside of the wrap angle of the belt 14 provides passages for the pumped medium to be taken into the chambers being expanded. The power to rotate the pump rotor, which rotates in the counter clockwise direction in FIGS. 2 and 3 can be supplied through the shaft 5 shown in FIG. 1 or through the shaft of idlers 45, 46 or 57 shown in FIGS. 2 and 3. At the specific moment of the rotation illustrated in FIGS. 2 and 3, the expanding-contracting chambers 29, 28 and 27 are under expansion process, while the expanding-contracting chambers 26 and 25 are under compression process. The expanding-contracting chamber 24 is fully contracted and pumps out the pumped medium through the opening 54 on the concentric valve cylinder 48. Said process repeats for each chambers and openings as the pump rotor rotates and, consequently, the pumped medium is continuously sucked into the eccentric shell 15 and pumped out from the concentric valve cylinder 48. In other words, the angular position belt valve pump 1 shown in FIG. 1 sucks pumped medium through the inlet 8 and pumps out through the outlet 9. It is obvious that, by reversing the arrangement of the wrap angles for the belts 14 and 47, the pump shown in FIG. 1 can be made to take in the pumped medium through the outlet 9 and pump out through the inlet 8. It is further obvious that many different means for controlling the pump characteristics can be incorporated. For example, the eccentricity of the eccentric shell 15 may be made to be adjustable to vary the compression ratios or the location of idlers 45, 46 or 55, 56 and 57 may be made to be adjustable to control the wrap angles to adjust the pumping characteristics to suit particular requirement. The expanding-contracting chambers may be constructed by using a plurality of bellows or the piston-cylinder combinations or the elastic bladders in place of the cavities in the elastic medium as shown in the particular embodiment. It should be understood that all pumps function as a hydraulic motor when the pressurized pumped medium is forced into the outlet port of the pump. The rotational angular position valve pump may be used as a hydraulic motor by directing a pressurized medium into the outlet port which medium leaves through the inlet port after doing work on said pump.

In FIGS. 4, 5, 6 and 7, there is shown another embodiment of the principles taught by the present invention, wherein a pair of the angular position belt valve are employed for the function of closing and opening the inlet and outlet of the pumping chambers while the eccentric shell arrangement is employed solely for the pumping. The pump rotor of the angular position belt valve pump 58 shown in FIG. 4, which is rotatably supported by means of shaft 64 and 66 engaging the bearings 66 and 67, respectively, comprises an intake angular position belt valve assembly 60, a pumping assembly 59 and and a discharge angular position belt valve assembly 61, which parts are inter-connected by a cylindrical extension 62 and 63. The intake compartment housing the intake angular position belt valve assembly 60 is sealed off by a seal 70 and a partitioning wall 68, while the discharge compartment housing the discharge angular position belt valve assembly 61 is sealed off by a seal 71 and a partitioning wall 69.

Figure 4:
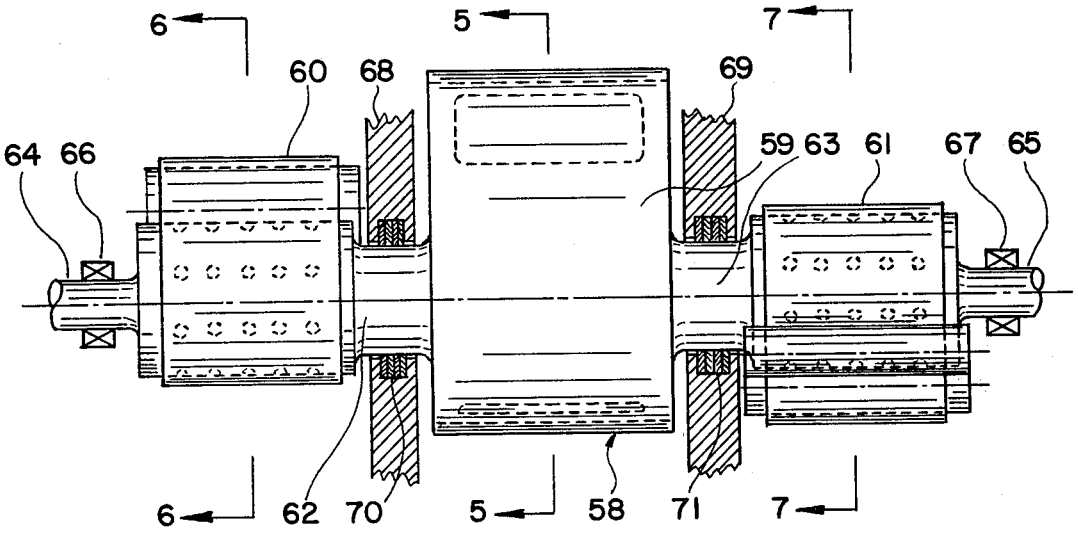
FIG. 4 illustrates an illustrative embodiment of another angular position belt valve pump viewed in a direction perpendicular to the axis of the rotation of said pump.
Figure 5:
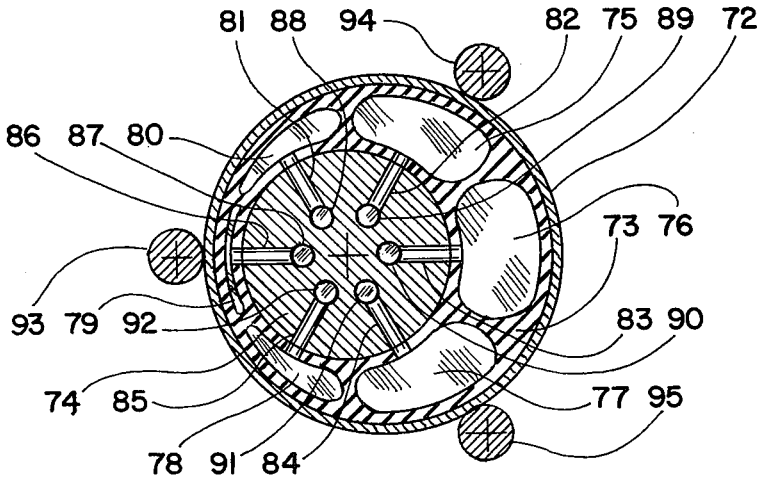
FIG. 5 illustrates a cross section of the angular position belt valve pump of FIG. 4 taken along a plane 5—5 as shown in FIG. 4.

In FIG. 5, there is shown a cross section taken along a plane 5—5 as shown in FIG. 4 illustrating the arrangement of the pumping assembly 59 comprising an eccentric shell 72, a concentric cylinder 74 with a plurality of axial holes 87, 88, 89, 90, 91 and 92, and the elastic medium 73 filling the space between the eccentric shell 72 and the concentric cylinder 74 which elastic medium includes a plurality of the expanding-contracting chambers 75, 76, 77, 78, 79 and 80, each of which chambers has openings connected to the axial holes 89, 90, 91, 92, 87 and 88, respectively, which openings are designated by 82, 83, 84, 85, 86 and 81, respectively. The eccentric position of the eccentric shell 72 is maintained by the rollers 93, 94 and 95. The eccentric shell 72 can be used as a driven pulley in driving the pump, in which case the eccentric position may be maintained by the driving belt tension.

Figure 6:
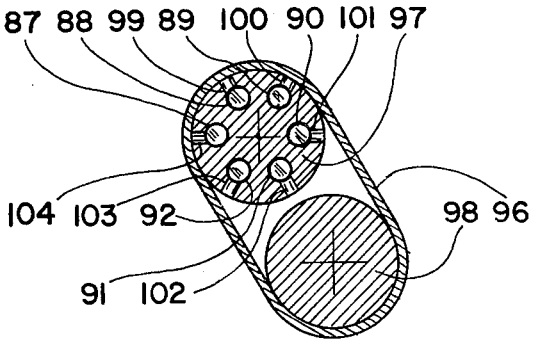
FIG. 6 illustrates another cross section of the angular position belt valve pump of FIG. 4 taken along a plane 6—6 as shown in FIG. 4.

There is shown in FIG. 6 a cross section taken along a plane 6—6 as shown in FIG. 4 showing the construction of the intake angular position belt valve assembly 60 including a belt 96, a concentric intake valve cylinder 97 with the axial holes 87, 88, 89, 90, 91 and 92, each of which axial holes is open to the cylindrical surface of the intake valve cylinder 97 by means of openings 104, 99, 100, 101, 102 and 103, respectively, and an idler 98 around which the belt 96 travels.

Figure 7:
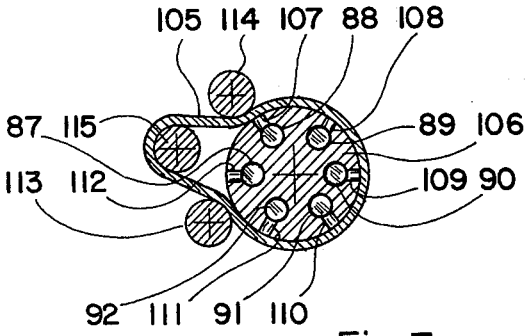
FIG. 7 illustrates a further cross section taken along a plane 7—7 as shown in FIG. 4.

There is shown in FIG. 7 a cross section taken along a plane 7—7 as shown in FIG. 4, illustrating the construction of the discharge angular position belt valve assembly 61 which has the same structure as that shown in FIG. 3, wherein a plurality of the axial hole-opening combinations 87-112, 88-107, 89-108, 90-109, 91-110 and 92-111 are disposed within the concentric discharge valve cylinder 106, which is wrapped around by a belt 105 being trained and tensioned by a plurality of idlers 113, 114 and 115.

At the particular instant depicted in FIGS. 5, 6 and 7, the expanding-contracting chambers 78, 77 and 76 are under expansion process taking in the pumped medium through the intake valve openings 103, 102 and 101, respectively, while the expanding-contracting chambers 75, 80 and 79 are under compression process wherein the fully or nearly fully contracted chamber 79 pumps out the medium through the discharge valve opening 112. It is obvious that the repeat of said sequence resulting from the rotation of the pump rotor creates a continuous pumping of the medium creating a vaccum at the intake valve assembly and a pressure in the discharge valve assembly. It should be also mentioned that the pumping assembly may employ so called gear-within-gear arrangement to facilitate the expanding-contracting chambers in place of eccentric shell with elastic pockets.

While the principles of the invention have now been made clear in an illustrative embodiment, there will be immediately obvious to those skilled in this type of work or those with sharp eyes many modifications of the structure, arrangement, proportions, the elements, materials and components used in the practice of the invention which are particularly adapted for specific environments and operating requirements without departing from those principles.

I claim:

1. An angular position belt valve pump or motor comprising:

(a) an angular position belt valve including:

(1) a first rotatable circular cylinder including a plurality of axial holes, each of said axial holes having one or more openings to the cylindrical surface of said first rotatable circular cylinder;

(2) a first belt wrapped around said first rotatable circular cylinder over a wrap angle less than 360 degrees;

(3) first one or more idlers training the path and the wrap angle of said first belt; wherein, the plurality of said one or more openings disposed on said cylindrical surface of said first rotatable circular cylinder and connected to each of said plurality of axial holes become cyclically open and closed as said plurality of said one or more openings become wrapped and unwrapped by said first belt when said first rotatable circular cylinder is rotated;

(b) a pumping assembly including:

(1) a second rotatable circular cylinder rigidly connected to said first rotatable circular cylinder of said angular position belt valve in a coaxial relationship wherein said plurality of the axial holes included in said first rotatable circular cylinder extend to said second rotatable circular cylinder;

(2) a circular cylindrical shell disposed around said second rotatable circular cylinder in an eccentric relationship;

(3) a plurality of the expanding-contracting chambers disposed intermediate said second rotatable circular cylinder and said circular cylindrical shell; each of said plurality of the expanding-contracting chambers including one or more openings to each of said axial holes and one or more openings to the cylindrical surface of said circular cylindrical shell;

(4) a second belt wrapped around said circular cylindrical shell over a wrap angle less than 360 degrees; and (5) second one or more idlers training the path and the wrap angle of said second belt and maintaining the eccentric position of said circular cylindrical shell with respect to said second rotatable circular cylinder wherein the expanding chamber of said plurality of the expanding-contracting chambers takes in the fluid medium through said one or more openings to the cylindrical surface of said first rotatable circular cylinder unwrapped by said first belt and the contracting chamber of said plurality of the expanding-contracting chambers discharges the fluid medium through said one or more openings to the cylindrical surface of said circular cylindrical shell unwrapped by said second belt when said first and second rotatable cylinders are rotated.

2. An angular position belt valve pump or motor comprising:

(a) an angular position belt valve including;

(1) a first rotatable circular cylinder including a plurality of axial holes, each of said axial holes having one or more openings to the cylindrical surface of said first rotatable circular cylinder;

(2) a first belt wrapped around said first rotatable circular cylinder over a wrap angle less than 360 degrees;

(3) first one or more idlers training the path and the wrap angle of said first belt; wherein, the plurality of said one or more openings disposed on said cylindrical surface of said first rotatable circular cylinder and connected to each of said plurality of axial holes become cyclically open and closed as said plurality of said one or more openings become wrapped and unwrapped by said first belt when said first rotatable circular cylinder is rotated;

(b) a pumping assembly including;

(1) a second rotatable circular cylinder rigidly connected to said first rotatable circular cylinder of said angular position belt valve in a coaxial relationship wherein said plurality of the axial holes included in said first rotatable circular cylinder extend to said second rotatable circular cylinder;

(2) a circular cylindrical shell disposed around said second rotatable circular cylinder in an eccentric relationship;

(3) a plurality of the expanding-contracting chambers disposed intermediate said second rotatable circular cylinder and said circular cylindrical shell; each of said plurality of the expanding-contracting chambers including one or more openings to each of said axial holes and one or more openings to the cylindrical surface of said circular cylindrical shell;

(4) a second belt wrapped around said circular cylindrical shell over a wrap angle less than 360 degrees; and (5) second one or more idlers training the path and the wrap angle of said second belt and maintaining the eccentric position of said circular cylindrical shell with respect to said second rotatable circular cylinder; wherein the expanding chamber of said plurality of expanding-contracting chambers takes in the fluid medium through said one or more openings to the cylindrical surface of said circular cylindrical shell unwrapped by said second belt and the contracting chamber of said plurality of expanding-contracting chamber discharges the fluid medium through said one or more openings to the cylindrical surface of said first rotatable circular cylinder unwrapped by said first belt when said first and second rotatable circular cylinders are rotated.

3. An angular position belt valve pump or motor comprising:

(a) a first angular position belt valve including;

(1) a first rotatable circular cylinder including a plurality of axial holes, each of said axial holes having one or more openings to the cylindrical surface of said first rotatable circular cylinder;

(2) a first belt wrapped around said first rotatable circular cylinder over a wrap angle less than 360 degrees;

(3) first one or more idlers training the path and the wrap angle of said first belt; wherein the plurality of said one or more openings disposed on said cylindrical surface of said first rotatable circular cylinder and connected to each of said plurality of axial holes become cyclically open and closed as said plurality of said one or more openings become wrapped and unwrapped by said first belt when said first rotatable circular cylinder is rotated;

(b) a second angular position belt valve including (1) a second rotatable circular cylinder including a plurality of axial holes, each of said axial holes having one or more openings to the cylindrical surface of said second rotatable circular cylinder;

(2) a second belt wrapped around said second rotatable circular cylinder over a wrap angle less than 360 degrees;

(3) second one or more idlers training the path and the wrap angle of said second belt; wherein the plurality of said one or more openings disposed on said cylindrical surface of said second rotatable circular cylinder and connected to each of said plurality of the axial holes become cyclically open and closed as said plurality of one or more openings become wrapped and unwrapped by said second belt when said second rotatable circular cylinder is rotated, wherein said wrap angle of said second angular position belt valve is out of phase with respect to the wrap angle of said first angular position belt valve;

(c) a pumping assembly comprising;

(1) a third rotatable circular cylinder rigidly connected to said first and second rotatable cylinders in a coaxial relationship wherein said plurality of axial holes disposed through said first and second rotatable circular cylinders extend to said third rotatable circular cylinder;

(2) a circular cylindrical shell disposed around said third rotatable circular cylinder in an eccentric relationship;

(3) a plurality of the expanding-contracting chambers disposed intermediate said third rotatable circular cylinder and said circular cylindrical shell, each of said plurality of the expanding-contracting chambers including one or more openings to each of said plurality of the axial holes disposed in said first rotatable circular cylinder and one or more openings to each of said plurality of holes disposed in said second rotatable circular cylinder wherein the expanding chamber of said plurality of the expanding-contracting chambers takes in the fluid medium through said one or more openings to the cylindrical surface of said first rotatable circular cylinder unwrapped by said first belt and the contracting chamber of said plurality of the expanding-contracting chambers discharges the fluid medium through said one or more openings to the cylindrical surface of said second rotatable circular cyclinder unwrapped by said second belt, when said first, second and third rotatable circular cylinders are rotated.

* * * * *